US007701409B2

(12) United States Patent
Slattman et al.

(10) Patent No.: US 7,701,409 B2
(45) **Date of Patent: *Apr. 20, 2010**

(54) SYSTEM AND METHOD FOR PROVIDING ANTENNA RADIATION PATTERN CONTROL

(75) Inventors: Peter Slattman, Malmo (SE); John Sanford, Encinitas, CA (US)

(73) Assignee: Cushcraft Corporation, Manchester, NH (US)

( * ) Notice: Subject to any disclaimer, the term of this patent is extended or adjusted under 35 U.S.C. 154(b) by 347 days.

This patent is subject to a terminal disclaimer.

(21) Appl. No.: 11/675,795

(22) Filed: Feb. 16, 2007

(65) Prior Publication Data

US 2007/0139278 A1 Jun. 21, 2007

Related U.S. Application Data

(63) Continuation-in-part of application No. 11/169,467, filed on Jun. 29, 2005, now Pat. No. 7,180,469.

(51) Int. Cl.
*H01Q 1/42* (2006.01)
*H01Q 15/14* (2006.01)

(52) U.S. Cl. ..... 343/872; 343/912

(58) Field of Classification Search ..... 343/754, 343/755, 815, 817, 818, 816, 819, 872, 912, 343/833, 834, 835, 837

See application file for complete search history.

(56) References Cited

U.S. PATENT DOCUMENTS

| | | | | |
|---|---|---|---|---|
| 5,710,569 | A * | 1/1998 | Oh et al. | 343/817 |
| 5,757,331 | A | 5/1998 | Yoneyama et al. | |
| 5,896,107 | A * | 4/1999 | Huynh | 343/700 MS |
| 6,295,028 | B1 * | 9/2001 | Jonsson et al. | 343/700 MS |
| 6,313,809 | B1 | 11/2001 | Gabriel et al. | |
| 6,529,167 | B2 * | 3/2003 | Webb | 343/700 MS |
| 6,747,607 | B1 | 6/2004 | Eckhardt et al. | |
| 6,774,852 | B2 | 8/2004 | Chiang et al. | |
| 6,795,035 | B2 * | 9/2004 | Jocher | 343/815 |
| 6,812,897 | B2 | 11/2004 | Jarmuszewski et al. | |
| 6,885,352 | B2 * | 4/2005 | Lee et al. | 343/836 |
| 6,943,732 | B2 | 9/2005 | Gottl et al. | |
| 7,075,498 | B2 | 7/2006 | Gottl et al. | |
| 7,084,836 | B2 | 8/2006 | Espenscheid et al. | |
| 7,245,267 | B2 * | 7/2007 | Gottl et al. | 343/872 |
| 7,427,966 | B2 * | 9/2008 | Boss et al. | 343/797 |

* cited by examiner

*Primary Examiner*—Hoang V Nguyen
*Assistant Examiner*—Robert Karacsony
(74) *Attorney, Agent, or Firm*—Harness, Dickey & Pierce, P.L.C.

(57) ABSTRACT

An antenna for providing radiation pattern control contains an antenna housing having a plurality of reflective wings and at least one linear element located above the reflective wings. The antenna also contains a radiation element situated within the antenna housing so as to allow the antenna housing to control a pattern of radiation emitted by the radiation element.

39 Claims, 12 Drawing Sheets

120

SYSTEM AND METHOD FOR PROVIDING ANTENNA RADIATION PATTERN CONTROL

CROSS-REFERENCE TO RELATED APPLICATION

This application claims priority to U.S. Provisional Application entitled, SYSTEM AND METHOD FOR PROVIDING ANTENNA RADIATION PATTERN CONTROL," having Ser. No. 11/169,467, filed Jun. 29, 2005, which is entirely incorporated herein by reference.

FIELD OF THE INVENTION

The present invention is generally related to antennas, and more particularly is related to providing antenna radiation pattern control.

BACKGROUND OF THE INVENTION

The wireless industry is continuously developing systems with higher data rates to satisfy the need for increased data capacity. In order to achieve higher over-the-air data transmission rates, the number of used channels is increased (i.e., higher over-the-air data rate sectorization) and a higher order modulation is used. In addition, it may be useful to alternate polarization between sectors or use polarization diversity, to enhance throughput.

Unfortunately, with an increase in the number of channels used for data transmission, interference between channels is required to be addressed. As an example, providers of wireless telecommunication technologies are required to ensure that they provide for proper wireless coverage within a specific frequency band, while minimizing interference with other frequency bands. In fact, interfering with other frequency bands may result in breaching of licenses associated with providing communication capabilities within a specific coverage area.

In order to minimize interference, a base station antenna may be required to illuminate a desired sector of transmission as uniformly as possible, while suppressing energy radiated in other directions. Unless controlled, energy may leak into undesired directions, forming small auxiliary beams called sidelobes. It is desirable to minimize or eliminate these sidelobes in order to minimize interference.

Dual polarization antennas transmit the electromagnetic energy in two orthogonal polarizations that are typically horizontal and vertical, but could also be left and right hand circular, or +/−45 degrees. The horizontally polarized component is oriented in a generally horizontal direction and the vertically polarized component is oriented in a generally vertical direction. In addition, the horizontally and vertically polarized components are oriented as orthogonal to one another. Unfortunately, controlling the distribution of radiated energy from a dual polarization antenna is difficult since vertical and horizontal polarized components experience different boundary conditions at material interfaces such as metal and plastic surfaces.

Multiple Input Multiple Output (MIMO) based systems are relatively new. They employ space-time processing to combine multiple signals in a fashion that increases total system throughput. The use of dual polarized antennas for diversity applications is well known to the industry. For example, in cellular telephony dual polarized +/−45 degree antennas are often used for diversity applications. However, their use in MIMO based systems has not been widely explored. In contrast to the antennas used for basic diversity techniques, we find that vertical/horizontal dual polarized antennas are preferred for MIMO based systems. This is due to the fact that most scatterers are either vertically or horizontally oriented. Hence, the maximum differences between signals is realized when vertical/horizontal antennas are used. This results in maximum MIMO system gain.

Thus, a heretofore unaddressed need exists in the industry to address the aforementioned deficiencies and inadequacies.

SUMMARY OF THE INVENTION

Embodiments of the present invention provide an antenna and method for providing radiation pattern control. Briefly described, in architecture, one embodiment of the antenna, among others, can be implemented as follows. The antenna for providing radiation pattern control contains an antenna housing. The antenna housing includes a mounting surface and a plurality of reflective wings extending from the mounting surface. The antenna housing has an inner surface and an outer surface. At least one linear element is located above the inner surface. A radiation element is situated along the mounting surface so as to allow said antenna housing to control a pattern of radiation emitted by said radiation element.

As mentioned above, the present invention can also be viewed as providing methods for providing radiation pattern control. In this regard, one embodiment of such a method, among others, can be broadly summarized by the following steps: transmitting electromagnetic energy from at least one radiator, the electromagnetic energy comprising a vertical electric field component and a horizontal electric field component; and controlling a pattern of radiation emitted by said at least one radiator through use of a plurality of reflective wings and at least one linear element.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
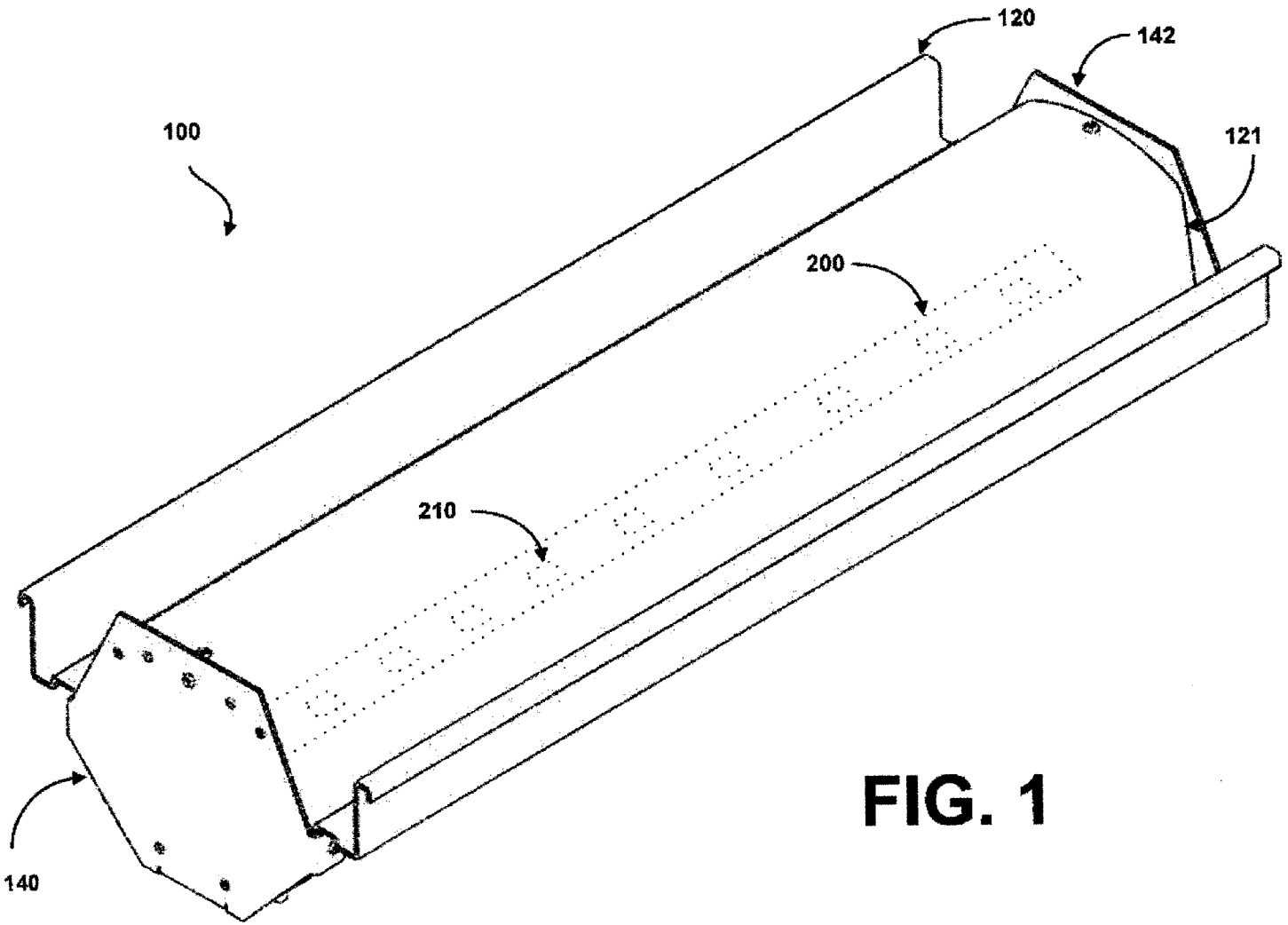
FIG. 1 is a schematic diagram providing a top perspective view of an antenna capable of radiation pattern control in accordance with the first exemplary embodiment of the invention.

The following describes a system and method for providing radiation pattern control via an antenna. FIG. 1 is a schematic diagram providing a top perspective view of an antenna 100 capable of radiation pattern control in accordance with the first exemplary embodiment of the invention. It should be noted that, for example, the antenna 100 may be a +/−45 degree dual polarized antenna, a left and right hand circular dual polarized antenna, and/or a singly vertically polarized antenna.

Figure 2A:
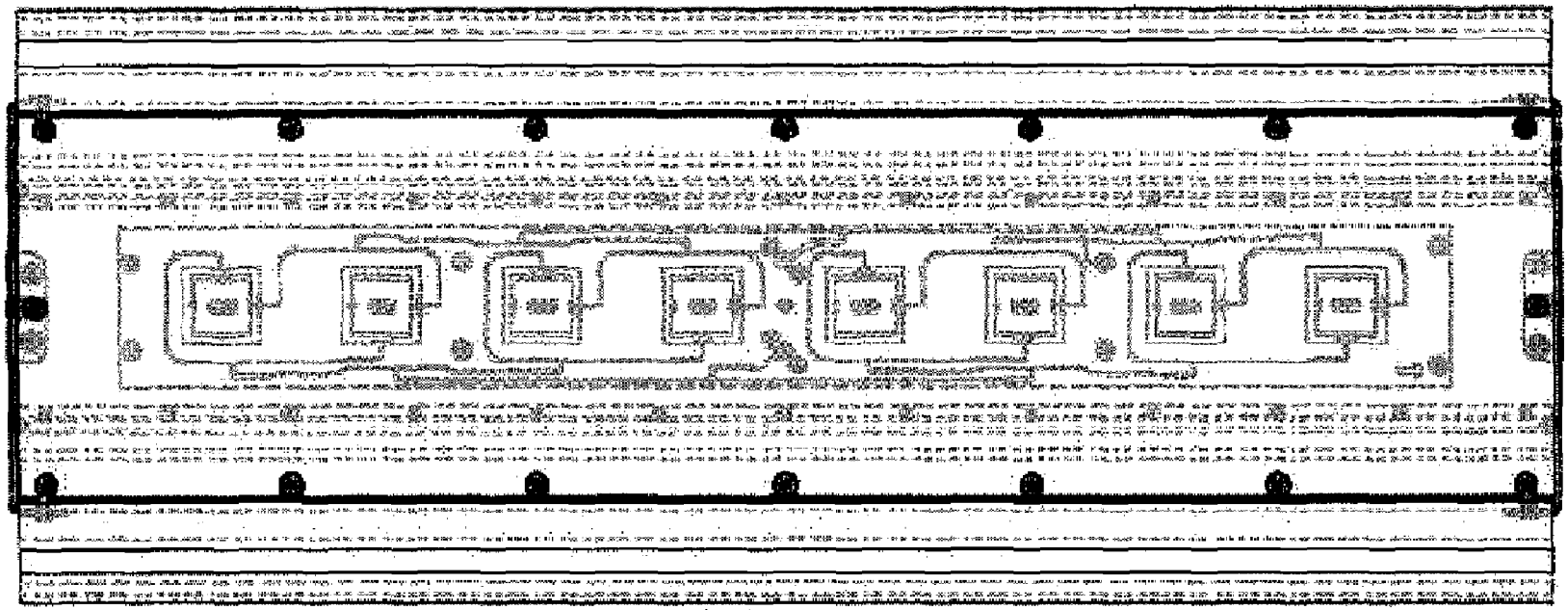
FIG. 2A is a schematic diagram providing a top view of the antenna housing of FIG. 1, having a cover portion removed in accordance with the first exemplary embodiment of the invention.
Figure 2B:
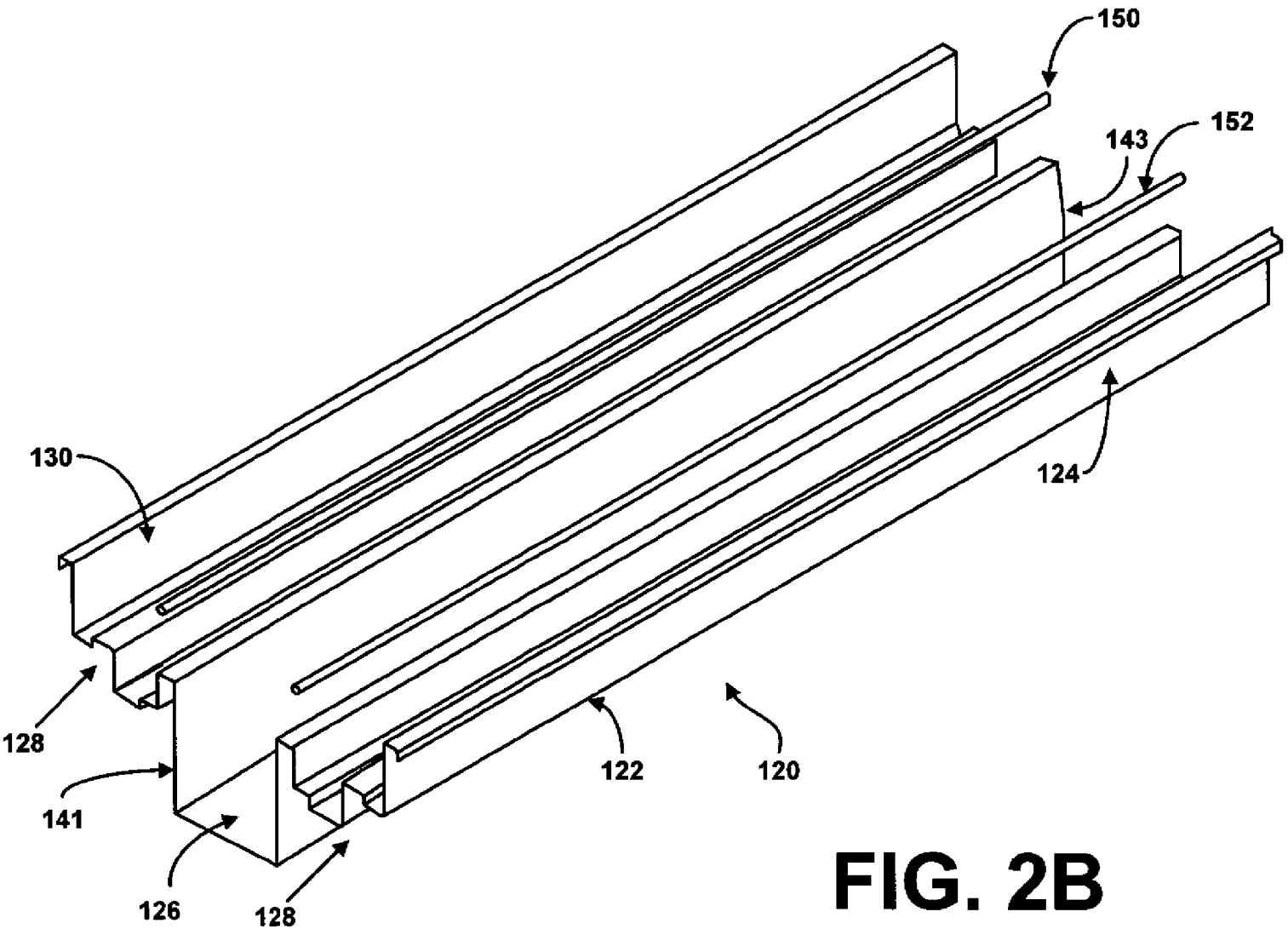
FIG. 2B is a schematic diagram providing a top perspective view of the antenna housing of FIG. 1, having the cover portion, a first side wall, and a second side wall removed in accordance with the first exemplary embodiment of the invention.

The antenna 100 contains an antenna housing 120 and a radiation element 200. It should be noted that the radiation element 200 is shown as being located beneath a cover portion 121 of the antenna housing 120. The antenna housing 120, which is further illustrated by the schematic diagrams of FIG. 2A and FIG. 2B, is designed to provide radiation pattern control for both vertical and horizontal electric field components of radiation emitted from the antenna 100. In addition, the radiation element 200, which is further illustrated by the schematic diagram of FIG. 4, contains a number of radiators 210. It should be noted that the number of radiators 210 shown in the figures to be located on the radiation element 200 is chosen for exemplary purposes and varying the number of radiators 210 is possible without deviating from the scope of the present invention. It should also be noted that the size and/or shape of the radiators 210 located on the radiation element 200 may be different from that illustrated by the figures herein, as would be known to one having ordinary skill in the art.

The cover portion 121 may be made of many different materials such as, but not limited to, thermoplastics such as different grades of ABS, polycarbonate, polyethylene, polypropylene, or different grades of fabrics or skins, as well as fiberglass reinforced plastics. Specifically, the cover portion 121 of the antenna housing 120 is made of a material that allows electromagnetic energy to flow there through, without significant interference to the electromagnetic radiation pattern provided by the antenna housing 120.

FIG. 2A is a schematic diagram providing a top view of the antenna housing 120 having the cover portion 121 removed in accordance with the first exemplary embodiment of the invention. FIG. 2B is a schematic diagram providing a top perspective view of the antenna housing 120 of FIG. 1, having the cover portion 121, a first side wall 140, and a second side wall 142 removed in accordance with the first exemplary embodiment of the invention.

As is shown by FIGS. 2A and 2B, the antenna housing 120 is a single conductive element having a plurality of wings 128 and linear elements 150, 152 therein for providing radiation pattern control, as is described in detail herein. The antenna housing 120 contains an outer body 122, where the outer body 122 contains an outer surface 124 and an inner surface 130. The inner surface 130 is characterized as the portion of the outer body 122 physically protected by the cover portion 121 (FIG. 1), while the outer surface 124 is characterized as the portion of the outer body 122 left exposed when the cover portion 121 (FIG. 1) is in place. The antenna housing 120 includes a mounting surface 126, upon which the radiators 210 (FIG. 1) are mounted. The antenna housing 120 also contains the first sidewall 140 (FIG. 1) and the second sidewall 142 (FIG. 1). The first sidewall 140 (FIG. 1) and the second sidewall 142 (FIG. 1) connect to a first side portion 141 of the outer body 122 and a second side portion 143 of the outer body 122, respectively. The side walls 140, 142 (FIG. 1) may be used to support a first linear element 150 and a second linear element 152 above the inner surface 130 of the outer body 122, where a central axis of the first linear element 150 and the second linear element 152 is substantially parallel to an axis of the outer body 122. The linear elements 150, 152 may also, or instead, be supported by a mechanical connection to the cover portion 121 (FIG. 1).

The antenna housing 120 and linear elements 150, 152 may be fabricated from different materials. Specifically, the material used to fabricate the antenna housing 120 and linear elements 150, 152 is capable of reflecting electromagnetic energy so as to provide a required radiation pattern. As an example, the antenna housing 120 and linear elements 150, 152 may be fabricated from aluminum, magnesium, galvanized steel, stainless steel, or conductively coated plastics. In addition, the shape of the antenna housing 120 and linear elements 150, 152 is dependent upon a required resulting radiation pattern. As an example, while the linear elements 150, 152 are shown to have a circular cross-sectional shape, any cross-sectional shape may be used to achieve objectives of the present invention. Possibilities for cross-sectional shapes of the linear elements 150, 152 include, but are not limited to, rectangular cross-sections, V-shaped cross-sections, and U-shaped cross-sections.

Figure 3:
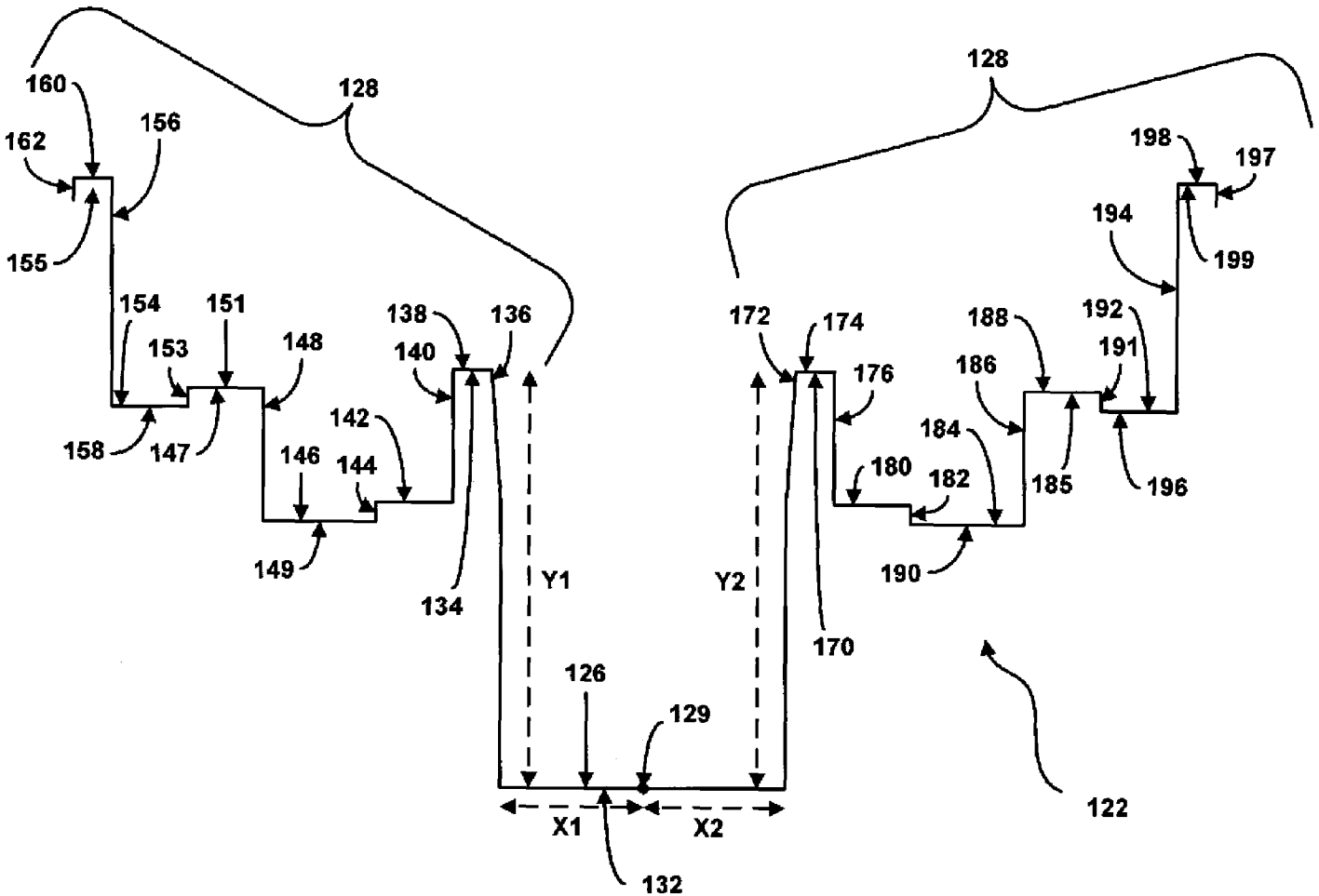
FIG. 3 is a cross-section of the outer body of the antenna housing of FIG. 2, in accordance with the first exemplary embodiment of the invention.

As has been mentioned above, the outer body 122 of the antenna housing 120 contains a plurality of wings 128 (described in detail below) that assist in providing radiation pattern control by reflecting electromagnetic radiation emitted by the radiation element 200 (FIG. 1). FIG. 3 is a cross-section of the outer body 122 of the antenna housing 120 of FIG. 2, in accordance with the first exemplary embodiment of the invention. As is shown by FIG. 3, and as is described in detail below, the inner surface 130 of the outer body 122 is defined by a plurality of wings 128 and a central trough 132. It should be noted that the shape of the antenna housing 120 is not intended to be limited to the shape described herein. Instead, the antenna housing 120 is intended to have at least one linear element 150, 152 extending above the inner surface 130 of the outer body 122 so as to allow shaping of a radiation pattern, where a vertical electric field component of radiation interacts with the at least one linear element 150, 152 and is shaped accordingly, while a horizontal electrical field component of the radiation is primarily unaffected by the at least one linear element 150, 152. It should also be noted that, while the antenna housing 120 is illustrated and described as having two linear elements 150, 152 therein, more or fewer linear elements may be provided within the antenna housing 120.

Describing the inner surface 130 of the outer body 122, starting from a central point 129 of the inner surface 130, located on the mounting surface 126 of the central trough 132 and extending to the left, a first step 134 of one of the wings 128 begins a distance X1 from the central point 129 of the inner surface 130 with a first step first side portion 136. The first step first side portion 136 extends vertically from the mounting surface 126 of the central trough 132, a distance Y1. In accordance with the first exemplary embodiment of the invention, the first step first side portion 136 meets the mounting surface 126 of the central trough 132 at approximately ninety degrees.

As is shown by FIG. 3, the distance Y1 is larger than other vertical distances within the inner surface 130, except for a distance Y2 discussed below. A first step top portion 138 extends horizontally and meets the first step first side portion 136. As is shown by FIG. 3, an upper portion of the first step first side portion 136 is angled outward away from the central trough 132. Angling of the upper portion of the first step first side portion 136 is provided to assist in shaping of a radiation pattern. While many of the angles shown in the wings 128 of FIG. 3 are right angles, there is no requirement of the invention that the angles be right angles.

The first step 134 also contains a first step second side portion 140, which extends vertically downward, away from the first step top portion 138. In accordance with the first exemplary embodiment of the invention, the first step second side portion 140 meets the first step top portion 138 at an angle of approximately ninety degrees. The first step second side portion 140 meets a second step top portion 142, where the second step top portion 142 extends horizontally and meets the first step second side portion 140 at approximately ninety degrees. A second step first side portion 144 extends vertically downward from the second step top portion 142 and meets the second step top portion 142 at approximately ninety degrees.

The second step first side portion 144, a first left bottom surface 146 and a third step first side portion 148 define a first left trough 149 located within the outer body 122 of the antenna housing 120. In accordance with the first exemplary embodiment of the invention, the third step first side portion 148 meets the first left bottom surface 146 at approximately ninety degrees. The third step first side portion 148 extends upward in a vertical direction and meets a third step top portion 151, where the third step top portion 151 extends in a horizontal direction. The third step first side portion 148 meets the third step top portion 151 at approximately ninety degrees.

A third step second side portion 153 meets the third step top portion 151 and extends downward in a vertical direction. As is shown by FIG. 3, the third step second side portion 153 meets the third step top portion 151 at approximately ninety degrees. The third step first side portion 148, the third step top portion 151 and the third step second side portion 153 define a third step 147 of the outer body 122.

The third step second side portion 153, a second left bottom surface 154, and a fourth step first side portion 156 define a second left trough 158 located within the outer body 122 of the antenna housing 120. In accordance with the first exemplary embodiment of the invention, the fourth step first side portion 156 meets the second left bottom surface 154 at approximately ninety degrees.

The fourth step first side portion 156 extends upward in a vertical direction and meets a fourth step top portion 160, where the fourth step top portion 160 extends in a horizontal direction. The fourth step first side portion 156 meets the fourth step top portion 160 at approximately ninety degrees. A fourth step second side portion 162 meets the fourth step top portion 160 and extends vertically downward from the fourth step top portion 160. In accordance with the first exemplary embodiment of the invention, the fourth step second side portion 162 meets the fourth step top portion 160 at approximately ninety degrees. The fourth step first side portion 156, the fourth step top portion 160, and the fourth step second side portion 162 define a fourth step 155 of the outer body 122.

Returning to the central point 129 of the inner surface 130, it should be noted that everything to the right of the central point 129 of the inner surface 130, which has not been described thus far, is a mirror image of everything to the left of the central point 129 of the inner surface 130, as described hereinabove.

Describing the inner surface 130 of the outer body 122, starting from the central point 129 of the inner surface 130, located on the mounting surface 126 of the central trough 132 and extending to the right, a fifth step 170 begins a distance X2 from the central point 129 of the inner surface 130 with a fifth step first side portion 172. It should be noted that distance X1 is preferably equal to distance X2, although in accordance with alternative embodiments of the invention, the distances may be different.

The fifth step first side portion 172 extends vertically from the mounting surface 126 of the central trough 132, a distance Y2. In accordance with the first exemplary embodiment of the invention, the fifth step first side portion 172 meets the mounting surface 126 of the central trough 132 at approximately ninety degrees.

As is shown by FIG. 3, the distance Y2 is preferably equal to the distance Y1. A fifth step top portion 174 extends horizontally and meets the fifth step first side portion 172. As is shown by FIG. 3, an upper portion of the fifth step first side portion 172 is angled outward away from the central trough 132. Angling of the upper portion of the fifth step first side portion 172 is provided to assist in shaping of a radiation pattern.

The fifth step 170 also contains a fifth step second side portion 176, which extends vertically downward, away from the fifth step top portion 174. In accordance with the first exemplary embodiment of the invention, the fifth step second side portion 176 meets the fifth step top portion 174 at an angle of approximately ninety degrees. The fifth step second side portion 176 meets a sixth step top portion 180, where the sixth step top portion 180 extends horizontally and meets the fifth step second side portion 176 at approximately ninety degrees. A sixth step first side portion 182 extends vertically downward from the sixth step top portion 180 and meets the sixth step top portion 180 at approximately ninety degrees.

The sixth step first side portion 182, a first right bottom surface 184 and a seventh step first side portion 186 define a first right trough 190 located within the outer body 122 of the antenna housing 120. In accordance with the first exemplary embodiment of the invention, the seventh step first side portion 186 meets the first right bottom surface 184 at approximately ninety degrees. The seventh step first side portion 186 extends upward in a vertical direction and meets a seventh step top portion 188, where the seventh step top portion 188 extends in a horizontal direction. The seventh step first side portion 186 meets the seventh step top portion 188 at approximately ninety degrees.

A seventh step second side portion 191 meets the seventh step top portion 188 and extends downward in a vertical direction. As is shown by FIG. 3, the seventh step second side portion 191 meets the seventh step top portion 188 at approximately ninety degrees. The seventh step first side portion 186, the seventh step top portion 188 and the seventh step second side portion 191 define a seventh step 185 of the outer body 122.

The seventh step second side portion 191, a second right bottom surface 192, and an eighth step first side portion 194 define a second right trough 196 located within the outer body 122 of the antenna housing 120. In accordance with the first exemplary embodiment of the invention, the seventh step first side portion 194 meets the second right bottom surface 192 at approximately ninety degrees.

The eighth step first side portion 194 extends upward in a vertical direction and meets an eighth step top portion 198, where the eighth step top portion 198 extends in a horizontal direction. The eighth step first side portion 194 meets the eighth step top portion 198 at approximately ninety degrees. An eighth step second side portion 197 meets the eighth step top portion 198 and extends vertically downward from the eighth step top portion 198. In accordance with the first exemplary embodiment of the invention, the eighth step second side portion 197 meets the eighth step top portion 198 at approximately ninety degrees. The eighth step first side portion 194, the eighth step top portion 198, and the eighth step second side portion 197 define an eighth step 199 of the outer body 122.

Figure 4:
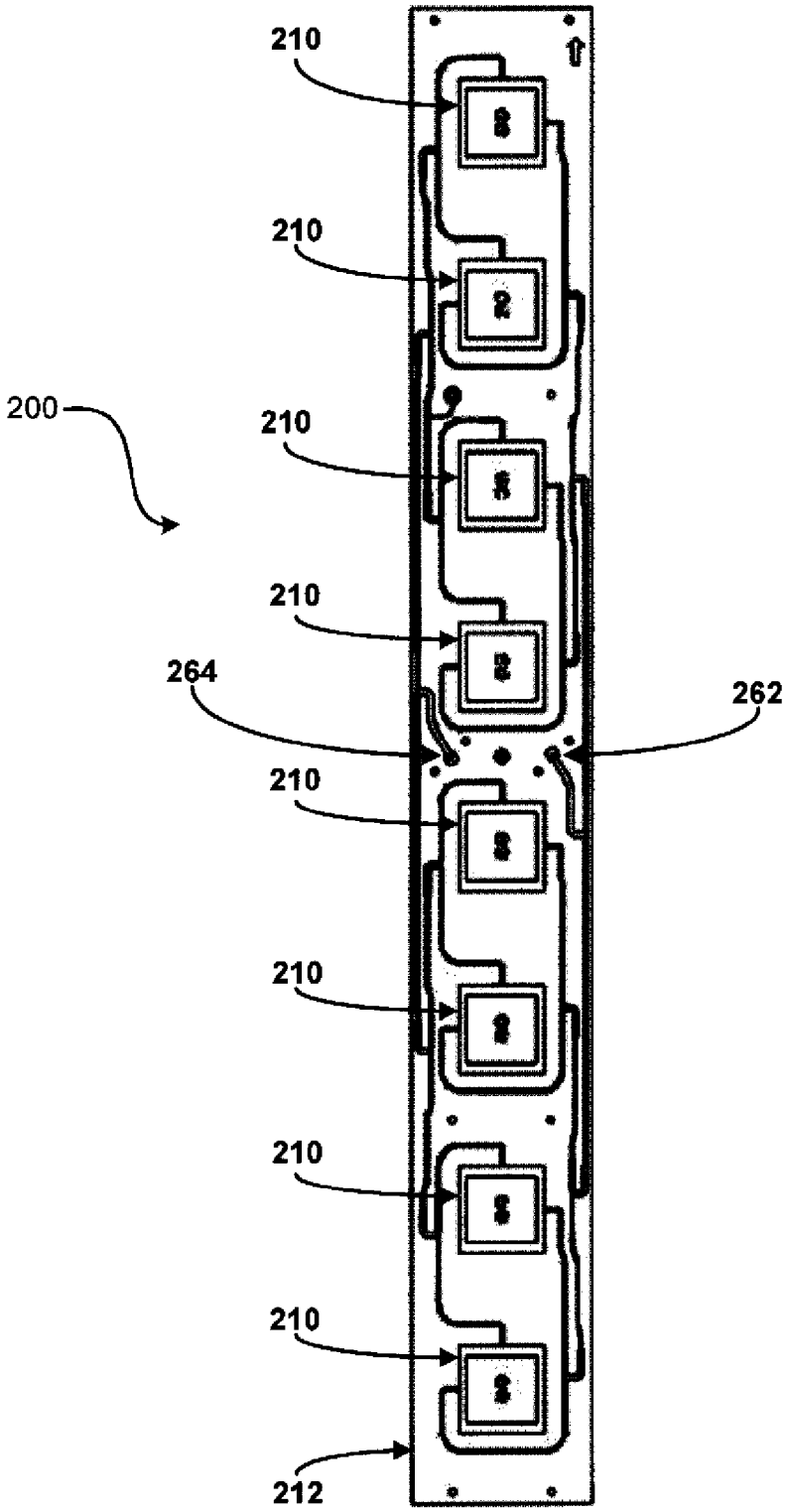
FIG. 4 is a schematic diagram illustrating the radiation element of FIG. 1, in accordance with the first exemplary embodiment of the invention.

FIG. 4 is a schematic diagram illustrating the radiation element 200 of FIG. 1, in accordance with the first exemplary embodiment of the invention. As is shown by FIG. 4, the radiation element 200 contains a number of radiators 210 thereon. It should be noted that the number of radiators 210 may be different from the number of radiators 210 shown in the figures to be located on the radiation element 200. It should also be noted that the size and/or shape of the radiators 210 located on the radiation element 200 may be different from that illustrated by the figures herein.

In accordance with the first exemplary embodiment of the invention, the radiators 210 are etched into a printed circuit board 212 so as to allow the radiators 210 to emit electromagnetic radiation provided by a source of the vertical polarized components and a source of the horizontal polarized components. Specifically, the radiators 210 may be made of any material capable of emitting electromagnetic radiation. In addition, the radiators 210 may be created by use of a method different from etching. One having ordinary skill in the art would know of such other methods of creation. It should also be noted that the radiators 210 may be provided in a form different from located on a printed circuit board and may include patch antennas, dipoles, and slots, as are known to those having ordinary skill in the art.

The electromagnetic energy is distributed from the connectors 250 and 252 (FIG. 5) on the backside of the antenna to the radiators 210 through a beam-forming network, such as, but not limited to copper traces etched on a printed circuit board. As was shown by FIG. 1, the radiation element 200 is located on the inner surface 130 of the antenna housing 120.

Figure 5:
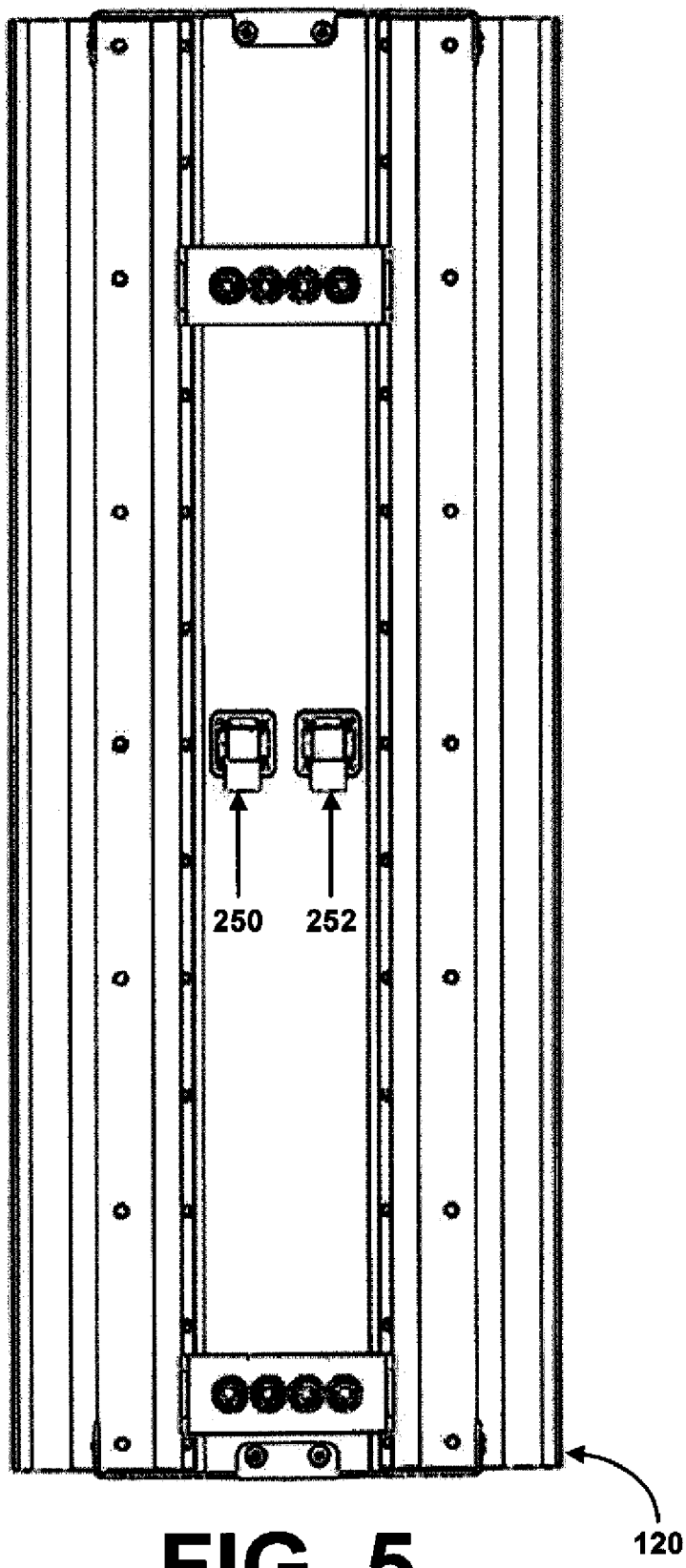
FIG. 5 is a schematic diagram illustrating a back portion of the antenna housing of FIG. 1 in accordance with the first exemplary embodiment of the invention.

FIG. 5 is a schematic diagram illustrating a back portion of the antenna housing 120 of FIG. 1, in accordance with the first exemplary embodiment of the present invention. As is shown by FIG. 5 the antenna housing 120 has a first connection point 250 and a second connection point 252. The first connection point 250 allows a vertical electric field component of radiation to enter the antenna housing 120. In addition, the second connection point 252 allows a horizontal electric field component of radiation to enter the antenna housing 120.

Referring to both FIG. 4 and FIG. 5, the first connection point 250 conductively connects to a first conductive point 262 located on the radiation element 200, while the second connection point 252 conductively connects to a second conductive point 264 located on the radiation element 200. Specifically, conductive paths may be provided within the antenna housing 120 to allow the vertical electric field component to travel from the first connection point 250 to the first conductive point 262, and the horizontal electric field component to travel from the second connection point 252 to the second conductive point 264.

Conductive paths are located within the radiation element 200, from each of the conductive points 262, 264 to specific radiators 210 located on the printed circuit board 212. As a result of the conductive paths, each radiator 210 emits a vertical electric field component and a horizontal electric field component independent of each other.

As mentioned above, the two linear elements 150, 152 extending above the inner surface 130 of the outer body 122 allow shaping of a radiation pattern, where the vertical electric field component of radiation interacts with the linear elements 150, 152 and is shaped accordingly, and where the horizontal electrical field component of the radiation is primarily unaffected by the linear elements 150, 152. The reason for this can be found in the expressions for the scattering cross-section of a thin conducting cylinder. The scattering cross-section diminishes as the inverse of the logarithm of the cylinder radius squared for the vertical polarization, and for the horizontal polarization the scattering cross section diminishes as the cylinder radius to the fourth power. For a cylinder diameter that is $1/20^{th}$ of the wavelength of the electromagnetic wave the power in the vertically polarized scattered wave is several orders of magnitude higher than the power in the horizontally polarized scattered wave. The electric field scattered off the linear elements 150, 152 helps shape the radiation pattern in a direct manner by adding to the radiation pattern directly, and indirectly by redirecting energy to the reflector wings 128 that then reflects the electric field in a controlled manner that adds to the radiation pattern. The exact location of the linear elements 150, 152 can be determined either by calculating the electromagnetic fields by solving Maxwell's equations, or by empirical trials based on electromagnetic field measurements.

In addition, the linear elements 150, 152 act to suppress side lobes as is further illustrated by FIGS. 6-9, which are described in detail hereafter.

Figure 7:
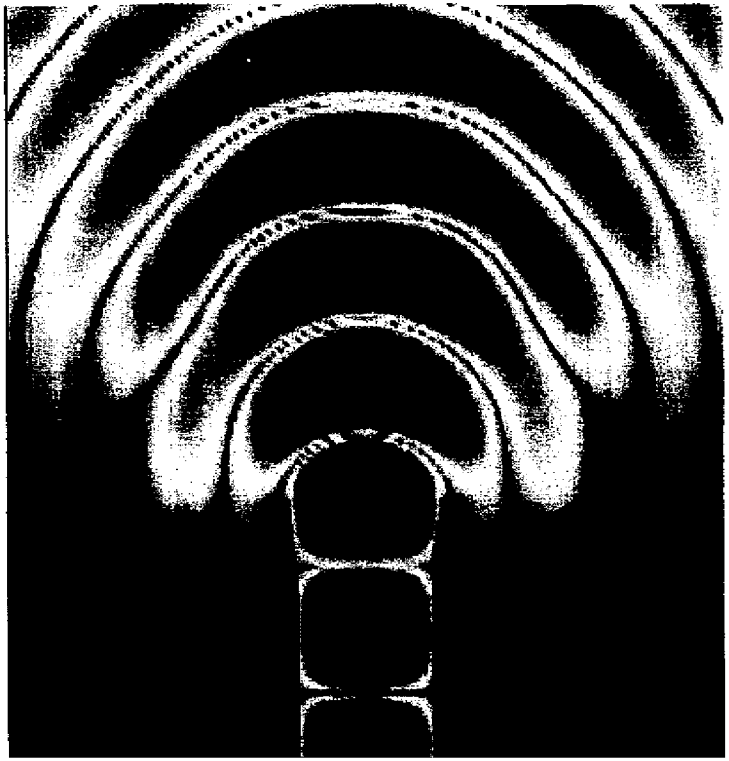
FIG. 7 is an exemplary illustration of a vertically polarized electric nearfield created by the antenna of FIG. 1 due to radiation pattern control provided by the antenna housing, without having the linear elements therein in accordance with the first exemplary embodiment of the invention.
Figure 6:
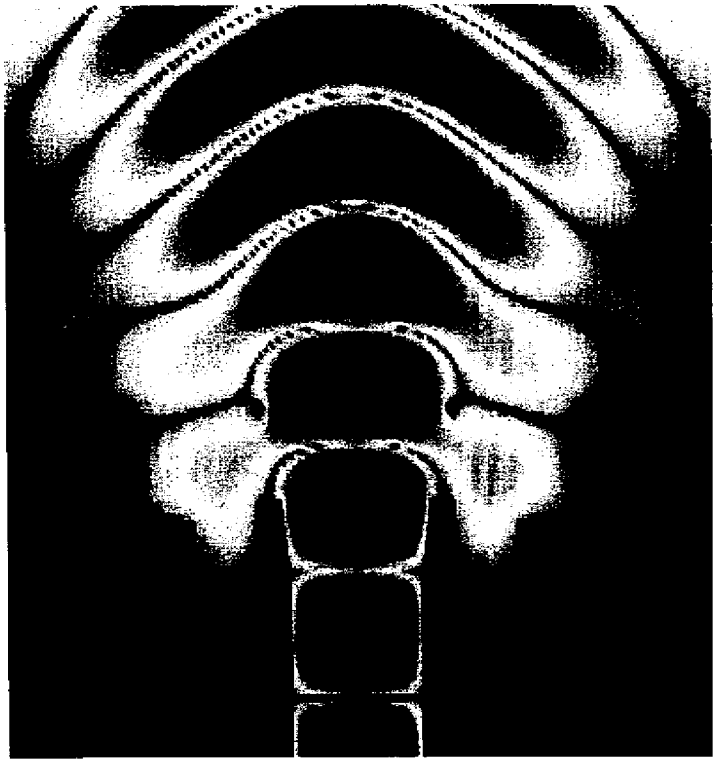
FIG. 6 is an exemplary illustration of a vertically polarized electric nearfield created by the antenna of FIG. 1 due to radiation pattern control provided by the antenna housing, having the linear elements therein in accordance with the first exemplary embodiment of the invention.

FIG. 6 is an exemplary illustration of a vertically polarized electric nearfield created by the present antenna 100 due to radiation pattern control provided by the antenna housing 120, having the linear elements 150, 152 therein in accordance with the first exemplary embodiment of the invention. For comparative purposes, FIG. 7 is an exemplary illustration of a vertically polarized electric nearfield created by the present antenna 100 due to radiation pattern control provided by the antenna housing 120 without having the linear elements 150, 152 therein in accordance with the first exemplary embodiment of the invention. As is shown by FIG. 6, the vertical electric field component of radiation interacts with the linear elements 150, 152 and is shaped accordingly.

Figure 9:
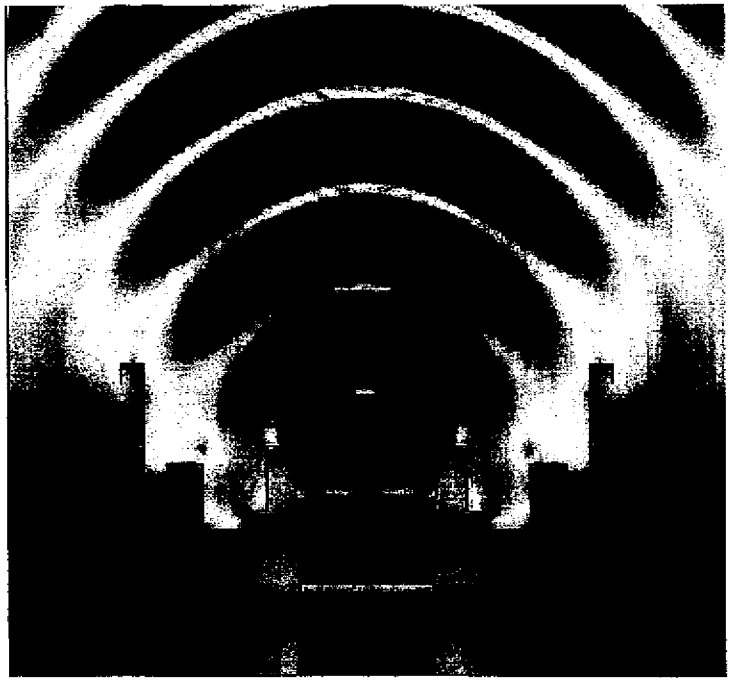
FIG. 9 is an exemplary illustration of a horizontally polarized electric nearfield created by the antenna of FIG. 1 due to radiation pattern control provided by the antenna housing, without having the linear elements therein in accordance with the first exemplary embodiment of the invention.
Figure 8:
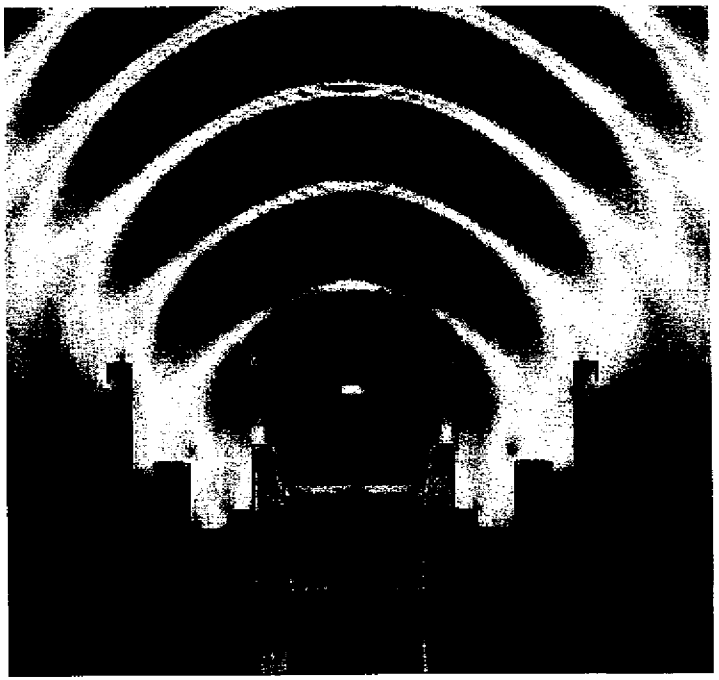
FIG. 8 is an exemplary illustration of a horizontally polarized electric nearfield created by the antenna of FIG. 1 due to radiation pattern control provided by the antenna housing, having the linear elements therein in accordance with the first exemplary embodiment of the invention.

FIG. 8 is an exemplary illustration of a horizontally polarized electric nearfield created by the present antenna 100 due to radiation pattern control provided by the antenna housing 120, having the linear elements 150, 152 therein in accordance with the first exemplary embodiment of the invention. For comparative purposes, FIG. 9 is an exemplary illustration of a horizontally polarized electric nearfield created by the present antenna 100 due to radiation pattern control provided by the antenna housing 120 without having the linear elements 150, 152 therein. As is shown by FIG. 8, the horizontal electrical field component of the radiation is primarily unaffected by the linear elements 150, 152.

It should be noted that the antenna 100 polarized nearfields of FIGS. 6-9 are derived from an antenna 100 that is designed to cover a sixty-degree sector with a power roll-off of 3 dB at +/−thirty-degree sector edges. Side lobe levels are designed to be suppressed more than 30 dB for azimuth angles beyond +/−90 degrees from a forward direction. Of course, the design mentioned herein is merely exemplary since other designs may be used as well, thereby providing coverage of different sectors, with a different power roll-off, and with a different amount of suppression of side lobe levels. It should be noted that use of the linear elements 150, 152 may make it possible to control the radiation pattern over a large frequency bandwidth since there is a large degree of freedom in design of the antenna 100, specifically, the placement of the linear elements 150, 152 and shape of the antenna 100 overall.

Figure 10:
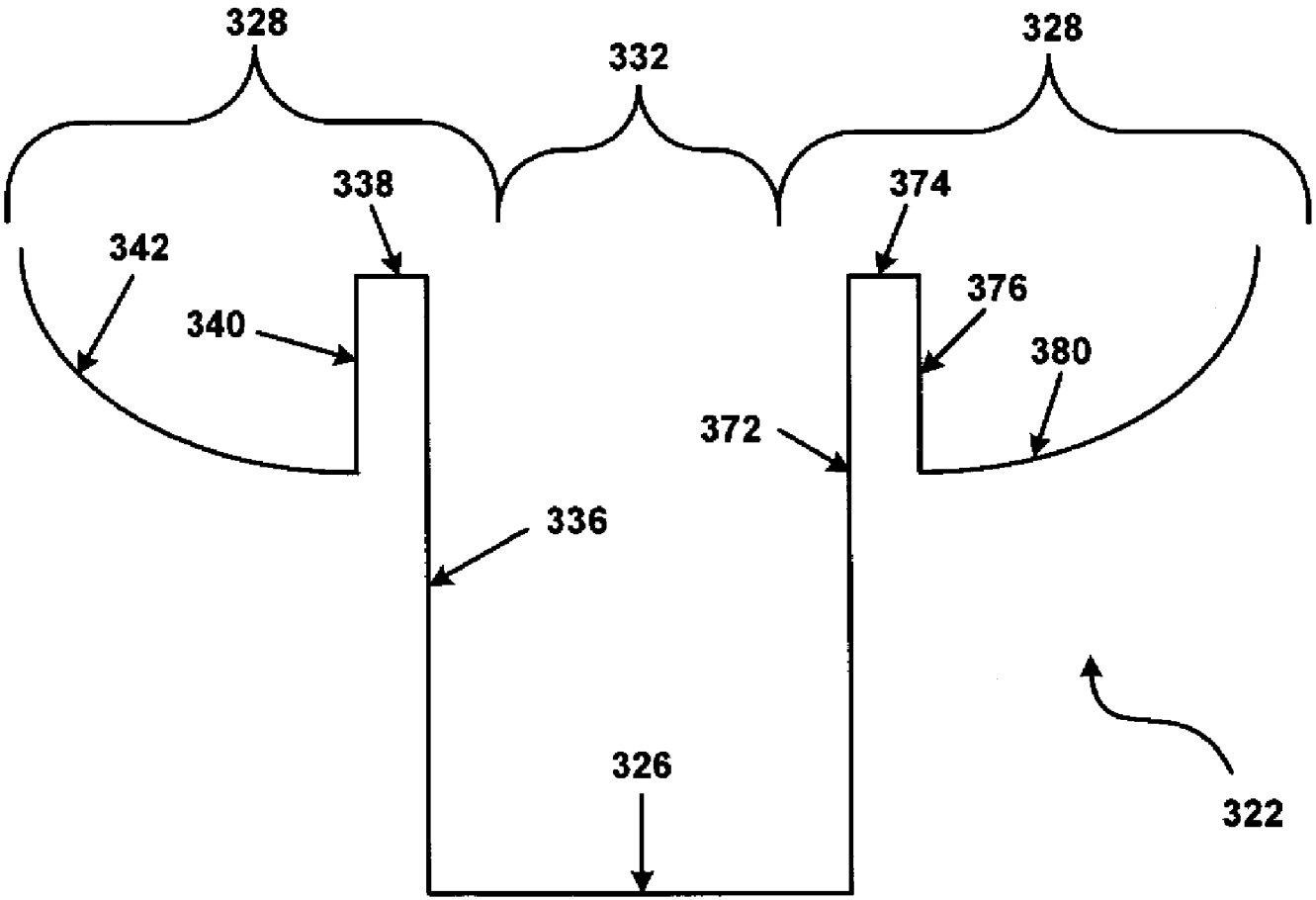
FIG. 10 is a cross-section of the outer body of an antenna housing, in accordance with a second exemplary embodiment of the invention.

FIG. 10 is a cross-section of the outer body 322 of an antenna housing 120, in accordance with a second exemplary embodiment of the invention. As is shown by FIG. 10, and as is described in detail below, the inner surface of the outer body 322 is defined by a plurality of wings 328 and a central trough 332. It should be noted that the shape of the outer body 322 is not intended to be limited to the shape described herein. Instead, the outer body 322 is intended to have at least one linear element 150, 152 extending above the mounting surface 326 of the outer body 322 so as to allow shaping of a radiation pattern, where a vertical electric field component of radiation interacts with the at least one linear element 150, 152 and is shaped accordingly, while a horizontal electrical field component of the radiation is primarily unaffected by the at least one linear element 150, 152. It should also be noted that, while the antenna housing 120 is illustrated and described as having two linear elements 150, 152 therein, more or fewer linear elements may be provided within the antenna housing 120.

Describing the outer body 322, starting from the mounting surface 326 of the central trough 332 and extending to the left, a first step of one of the wings 328 begins with a first step first side portion 336. The first step first side portion 336 extends vertically from the mounting surface 326 of the central trough 332. In accordance with the second exemplary embodiment of the invention, the first step first side portion 336 meets the mounting surface 326 of the central trough 332 at an approximately ninety degree angle.

As is shown by FIG. 10, a first step top portion 338 extends horizontally and meets the first step first side portion 336. An upper portion of the first step first side portion 336 is angled outward away from the central trough 332. Angling of the upper portion of the first step first side portion 336 is provided to assist in shaping of a radiation pattern.

The first step top portion 338 also connects to a first step second side portion 340, which extends vertically downward, away from the first step top portion 338. In accordance with the second exemplary embodiment of the invention, the first step second side portion 340 meets the first step top portion 338 at an angle of approximately ninety degrees. The first step second side portion 340 meets a first arcuate wing portion 342, where the first arcuate wing portion 342 extends horizontally and meets the first step second side portion 340 at an angle of approximately 105 degrees. As is shown in FIG. 10, the wings 328 are symmetric across the central trough 332. Starting from the mounting surface 326 of the central trough 332 and extending to the right, a second step of one of the wings 328 begins with a second step first side portion 372. The second step first side portion 372 extends vertically from the mounting surface 326 of the central trough 332. In accordance with the second exemplary embodiment of the invention, the second step first side portion 372 meets the mounting surface 326 of the central trough 332 at an approximately ninety degree angle.

As is shown by FIG. 10, a second step top portion 374 extends horizontally and meets the second step first side portion 372. An upper portion of the second step first side portion 372 is angled outward away from the central trough 332. Angling of the upper portion of the second step first side portion 372 is provided to assist in shaping of a radiation pattern.

The second step top portion 374 also connects to a second step second side portion 376, which extends vertically downward, away from the second step top portion 374. In accordance with the second exemplary embodiment of the invention, the second step second side portion 376 meets the second step top portion 374 at an angle of approximately ninety degrees. The second step second side portion 376 meets a second arcuate wing portion 380, where the second arcuate wing portion 380 extends horizontally and meets the second step second side portion 376 at an angle of approximately one hundred five degrees.

Figure 11:
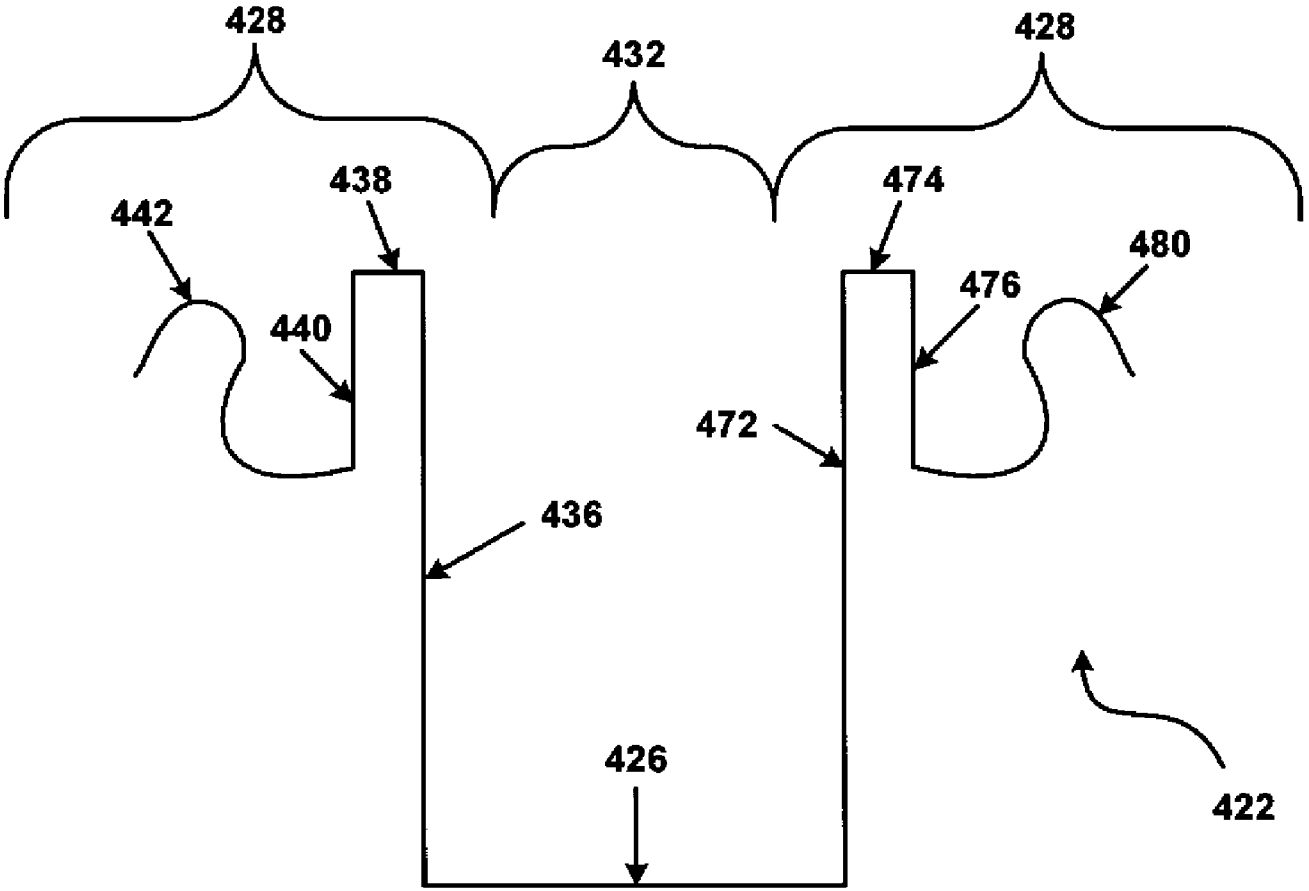
FIG. 11 is a cross-section of the outer body of an antenna housing, in accordance with a third exemplary embodiment of the invention.

FIG. 11 is a cross-section of the outer body 422 of an antenna housing 120, in accordance with a third exemplary embodiment of the invention. As is shown by FIG. 11, and as is described in detail below, the inner surface of the outer body 422 is defined by a plurality of wings 428 and a central trough 432. It should be noted that the shape of the outer body 422 is not intended to be limited to the shape described herein. Instead, the outer body 422 is intended to have at least one linear element 150, 152 extending above the mounting surface 426 of the outer body 422 so as to allow shaping of a radiation pattern, where a vertical electric field component of radiation interacts with the at least one linear element 150, 152 and is shaped accordingly, while a horizontal electrical field component of the radiation is primarily unaffected by the at least one linear element 150, 152. It should also be noted that, while the antenna housing 120 is illustrated and described as having two linear elements 150, 152 therein, more or fewer linear elements may be provided within the antenna housing 120.

Describing the outer body 422, starting from the mounting surface 426 of the central trough 432 and extending to the left, a first step of one of the wings 428 begins with a first step first side portion 436. The first step first side portion 436 extends vertically from the mounting surface 426 of the central trough 432. In accordance with the third exemplary embodiment of the invention, the first step first side portion 436 meets the mounting surface 426 of the central trough 432 at an approximately ninety degree angle.

As is shown by FIG. 11, a first step top portion 438 extends horizontally and meets the first step first side portion 436. An upper portion of the first step first side portion 436 is angled outward away from the central trough 432. Angling of the upper portion of the first step first side portion 436 is provided to assist in shaping of a radiation pattern.

The first step top portion 438 also connects to a first step second side portion 440, which extends vertically downward, away from the first step top portion 438. In accordance with the third exemplary embodiment of the invention, the first step second side portion 440 meets the first step top portion 438 at an angle of approximately ninety degrees. The first step second side portion 440 meets a first arcuate wing portion 442, where the first arcuate wing portion 442 extends horizontally and meets the first step second side portion 440 at an angle of approximately 105 degrees. As is shown in FIG. 11, the wings 428 are symmetric across the central trough 432. Starting from the mounting surface 426 of the central trough 432 and extending to the right, a second step of one of the wings 428 begins with a second step first side portion 472. The second step first side portion 472 extends vertically from the mounting surface 426 of the central trough 432. In accordance with the third exemplary embodiment of the invention, the second step first side portion 472 meets the mounting surface 426 of the central trough 432 at an approximately ninety degree angle.

As is shown by FIG. 11, a second step top portion 474 extends horizontally and meets the second step first side portion 472. An upper portion of the second step first side portion 472 is angled outward away from the central trough 432. Angling of the upper portion of the second step first side portion 472 is provided to assist in shaping of a radiation pattern.

The second step top portion 474 also connects to a second step second side portion 476, which extends vertically downward, away from the second step top portion 474. In accordance with the third exemplary embodiment of the invention, the second step second side portion 476 meets the second step top portion 474 at an angle of approximately ninety degrees. The second step second side portion 476 meets a second arcuate wing portion 480, where the second arcuate wing portion 480 extends horizontally and meets the second step second side portion 476 at an angle of approximately one hundred five degrees.

While the second and third exemplary embodiments show two different styles of arcuate wing portions 328, 428, these examples are not intended to be limiting and other styles of arcuate wing portions 328, 428 are considered to be within the scope of the present invention.

Figure 12:
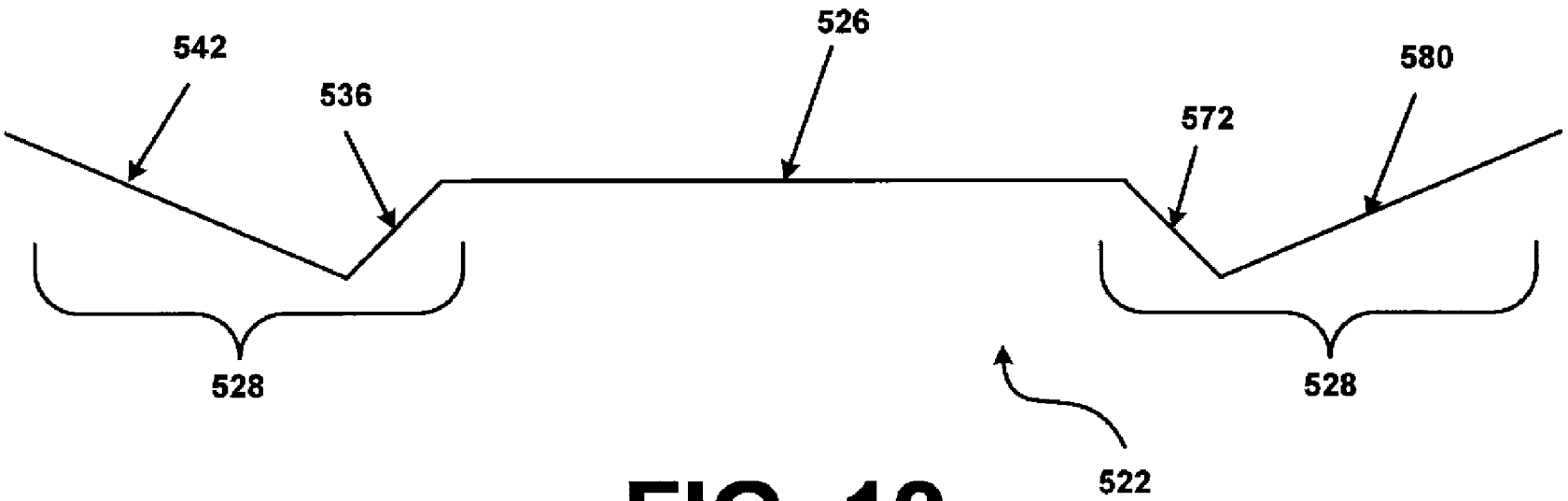
FIG. 12 is a cross-section of the outer body of an antenna housing, in accordance with a fourth exemplary embodiment of the invention.

FIG. 12 is a cross-section of the outer body 522 of an antenna housing 120, in accordance with a fourth exemplary embodiment of the invention. As is shown by FIG. 12, and as is described in detail below, the inner surface of the outer body 522 is defined by a plurality of wings 528 and a mounting portion 526. It should be noted that the shape of the outer body 522 is not intended to be limited to the shape described herein. Instead, the outer body 522 is intended to have at least one linear element 150, 152 extending above the mounting surface 526 of the outer body 522 so as to allow shaping of a radiation pattern, where a vertical electric field component of radiation interacts with the at least one linear element 150, 152 and is shaped accordingly, while a horizontal electrical field component of the radiation is primarily unaffected by the at least one linear element 150, 152. It should also be noted that, while the antenna housing 120 is illustrated and described as having two linear elements 150, 152 therein, more or fewer linear elements may be provided within the antenna housing 120.

Describing the outer body 522, starting from the mounting surface 526 and extending to the left, a first step of one of the wings 528 begins with a first step portion 536. The first step portion 536 extends angularly from the mounting surface 526. In accordance with the fourth exemplary embodiment of the invention, the first step portion 536 meets the mounting surface 526 at an approximately two hundred twenty-five degree angle.

As is shown by FIG. 12, a second step portion 542 extends angularly from the first step portion 536. The second step portion 542 extends angularly upward. In accordance with the fourth exemplary embodiment of the invention, the second step portion 542 meets the first step portion 536 at an angle of approximately one hundred five degrees.

As is shown in FIG. 12, the wings 528 are symmetric across the mounting surface 526. Starting from the mounting surface 526 and extending to the right, a first step of one of the wings 528 begins with a third step portion 572. The third step portion 572 extends angularly from the mounting surface 526. In accordance with the fourth exemplary embodiment of the invention, the third step portion 572 meets the mounting surface 526 at an approximately two hundred twenty-five degree angle.

As is shown by FIG. 12, a fourth step portion 580 extends angularly from the third step portion 572. The fourth step portion 580 extends angularly upward. In accordance with the fourth exemplary embodiment of the invention, the fourth step portion 580 meets the third step portion 572 at an angle of approximately one hundred five degrees.

Figure 13:
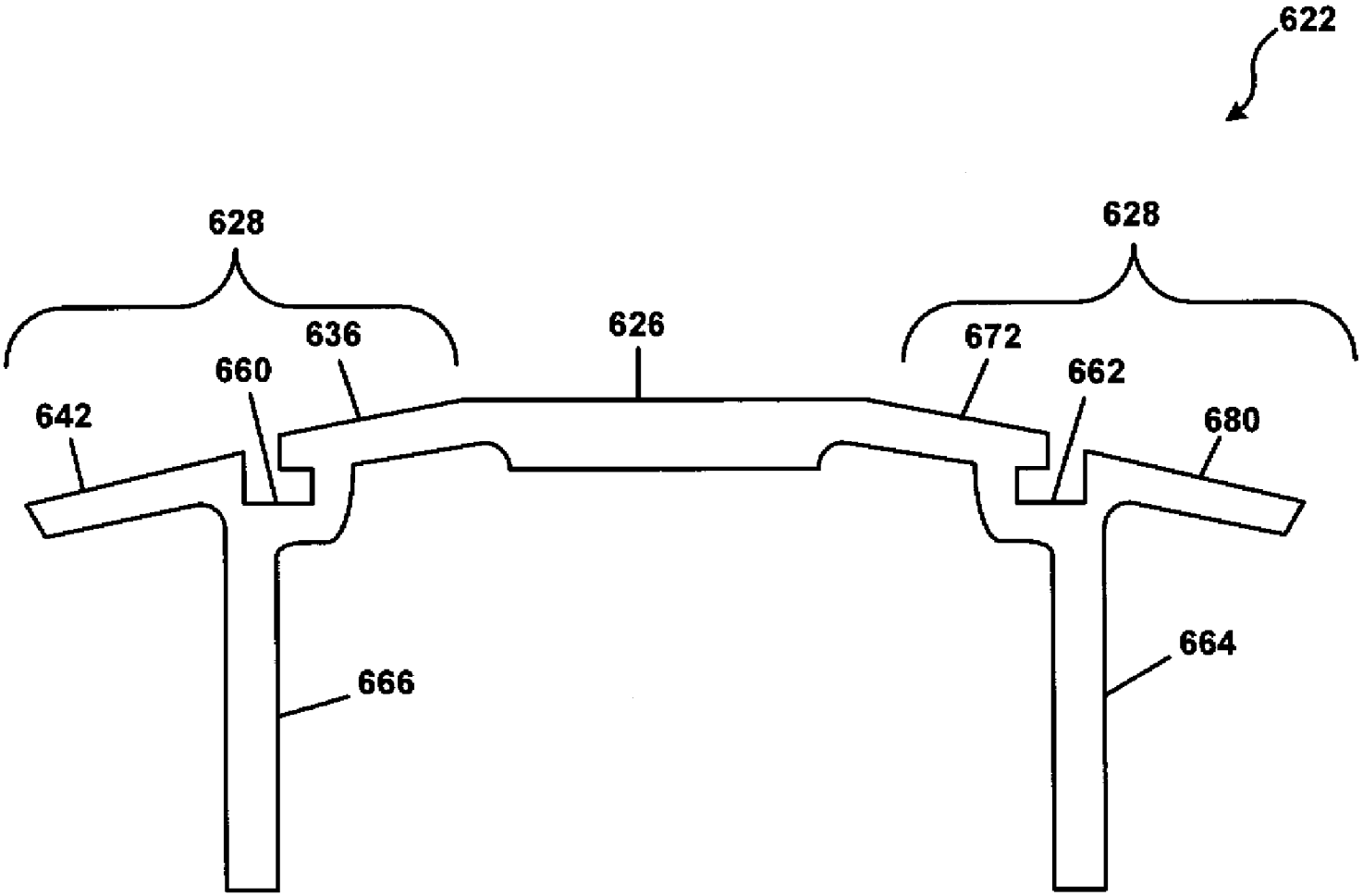
FIG. 13 is a cross-section of the outer body of an antenna housing, in accordance with a fifth exemplary embodiment of the invention.

FIG. 13 is a cross-section of the outer body 622 of an antenna housing 120, in accordance with a fifth exemplary embodiment of the invention. As is shown by FIG. 13, and as is described in detail below, the inner surface of the outer body 622 is defined by a plurality of wings 628 and a mounting surface 626. It should be noted that the shape of the outer body 622 is not intended to be limited to the shape described herein. Instead, the outer body 622 is intended to have at least one linear element 150, 152 extending above the mounting surface 626 of the outer body 622 so as to allow shaping of a radiation pattern, where a vertical electric field component of radiation interacts with the at least one linear element 150, 152 and is shaped accordingly, while a horizontal electrical field component of the radiation is primarily unaffected by the at least one linear element 150, 152. It should also be noted that, while the antenna housing 120 is illustrated and described as having two linear elements 150, 152 therein, more or fewer linear elements may be provided within the antenna housing 120.

Describing the outer body 622, starting from the mounting surface 626 and extending to the left, a first step of one of the wings 628 begins with a first step portion 636. The first step portion 636 extends angularly from the mounting surface 626. In accordance with the fifth exemplary embodiment of the invention, the first step portion 636 meets the mounting surface 626 at an approximately one hundred ninety degree angle.

As is shown by FIG. 13, a first receiving void 660 is formed at an end of the first step portion 636. The first receiving void 660 receives the cover, providing mechanical connection between the outer body 622 and the cover. A second step portion 642 extends from the first receiving void 660. The second step portion 642 may extend at approximately the same angle as the first step portion 636. In accordance with the fifth exemplary embodiment of the invention, a first mounting feature 666 is provided behind the second step portion 642. The first mounting feature 666 may be used to mount the antenna housing 120 without significant interference to the electromagnetic radiation pattern provided by the antenna housing 120. Otherwise, mounting of antenna housings 120 is well known to those having ordinary skill in the art.

As is shown in FIG. 13, the wings 628 are symmetric across the mounting surface 626. Starting from the mounting surface 626 and extending to the right, a first step of one of the wings 628 begins with a third step portion 672. The third step portion 672 extends angularly from the mounting surface 626. In accordance with the fifth exemplary embodiment of the invention, the third step portion 672 meets the mounting surface 626 at an approximately one hundred ninety degree angle.

As is shown by FIG. 13, a second receiving void 662 is formed at an end of the third step portion 672. The second receiving void 662 receives the cover, in conjunction with the first receiving void 660, providing mechanical connection between the outer body 622 and the cover. A fourth step portion 680 extends angularly from the second receiving void 662. The fourth step portion 680 may extend at approximately the same angle as the third step portion 672. In accordance with the fifth exemplary embodiment of the invention, a second mounting feature 664 is provided behind the fourth step portion 680. The second mounting feature 664 may be used to mount the antenna housing 120 without significant interference to the electromagnetic radiation pattern provided by the antenna housing 120. Otherwise, mounting of antenna housings 120 is well known to those having ordinary skill in the art.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. An antenna for providing radiation pattern control, comprising:

an antenna housing comprising a mounting surface and a plurality of reflective wings including first and second series of reflective wings extending from respective first and second sides of the mounting surface, the antenna housing having an inner surface and an outer surface;

at least one linear element located above and spaced apart from the mounting surface; and a radiation element situated along the mounting surface so as to allow said antenna housing to control a pattern of radiation emitted by said radiation element.

2. The antenna of claim 1, wherein said radiation element further comprises at least one radiator capable of emitting electromagnetic energy, where said electromagnetic energy comprises a vertical electric field component and a horizontal electric field component.

3. The antenna of claim 2, wherein said antenna housing further comprises:

a cover capable of being placed over said mounting surface and at least a portion of said reflective wings, wherein said cover does not effect the pattern of radiation emitted by said radiation element; and at least one connection point for receiving said vertical electric field component and said horizontal electric field component.

4. The antenna of claim 2, wherein said antenna housing conductively allows said vertical electric field component and said horizontal electric field component to be received by said radiation element.

5. The antenna of claim 2, wherein said vertical electric field component emitted by said at least one radiator interacts with said at least one linear element and is shaped accordingly, while said horizontal electrical field component is primarily unaffected by said at least one linear element.

6. The antenna of claim 1, wherein said reflective wings are symmetrical about the mounting surface.

7. The antenna of claim 1, wherein said radiation element further comprises a printed circuit board and at least one radiator located on said printed circuit board, said at least one radiator being capable of emitting electromagnetic energy, where said electromagnetic energy comprises a vertical electric field component and a horizontal electric field component.

8. The antenna of claim 1, wherein the reflective wings each further comprise a curved portion.

9. The antenna of claim 1, wherein said antenna housing further comprises a first side wall and a second side wall mounted to opposing sides of the mounting surface, said at least one linear element being connected to said first side wall and said second side wall.

10. The antenna of claim 1, further comprising a cover capable of being placed over said mounting surface and at least a portion of said reflective wings, wherein said cover does not affect the pattern of radiation emitted by said radiation element; wherein at least one linear element is attached to the cover.

11. The antenna of claim 1, wherein said reflective wings further comprise a plurality of straight reflective elements having angled joints.

12. The antenna of claim 1, wherein said antenna is a +/−45 degree dual polarized antenna.

13. The antenna of claim 1, wherein said antenna is a left and right hand circular dual polarized antenna.

14. The antenna of claim 1, wherein said linear element is approximately less than half as wide as the mounting surface.

15. A method of providing radiation pattern control, comprising the steps of:

transmitting electromagnetic energy from at least one radiator, the electromagnetic energy comprising a vertical electric field component and a horizontal electric field component; and controlling a pattern of radiation emitted by said at least one radiator through use of a plurality of reflective wings and at least one linear element, the plurality of reflective wings including first and second series of reflective wings extending from respective first and second sides of a mounting surface of an antenna housing, the at least one linear element being located above and spaced apart from an inner surface of the mounting surface.

16. The method of claim 15, wherein said step of controlling said pattern of radiation further comprises the step of shaping said vertical electric field component.

17. An antenna for providing radiation pattern control, comprising:

means for radiating, said means for radiating being capable of transmitting a vertical electric field component and a horizontal electric field component;

means for providing said vertical electric field component and said horizontal electric field component to said means for radiating; and means for controlling a pattern of radiation emitted by said means for radiating through use of a plurality of reflective wings and at least one linear element, the plurality of reflective wings including first and second series of reflective wings extending from respective first and second sides of a mounting surface of an antenna housing, the at least one linear element being located above and spaced apart from an inner surface of the mounting surface.

18. An antenna for providing radiation pattern control, comprising:

an antenna housing including a mounting surface and a plurality of reflective surfaces including first and second series of reflective surfaces extending from respective first and second sides of the mounting surface, the antenna housing having an inner surface and an outer surface;

at least one linear element located above the mounting surface; and a radiation element situated along the mounting surface so as to allow said antenna housing to control a pattern of radiation emitted by said radiation element.

19. The antenna of claim 18, wherein the reflective surfaces comprise a series of reflective steps extending from the mounting surface.

20. The antenna of claim 19, wherein the reflective surfaces comprise a plurality of reflective wings extending from the mounting surface.

21. The antenna of claim 18, wherein the at least one linear element comprises at least one rod located above the inner surface of the antenna housing.

22. The antenna of claim 18, wherein the reflective surfaces comprise a first set of reflective surfaces and a second set of reflective surfaces, wherein said first set of reflective surfaces is a mirror-image of said second set of reflective surfaces such that the first and second sets of reflective surfaces are symmetrical about a central trough of said antenna housing.

23. The antenna of claim 19, wherein the reflective surfaces include:

a first step portion extending generally angularly downward from a first side of the mounting surface;

a second step portion extending angularly upward from the first step portion;

a third step portion extending angularly downward from a second side of the mounting surface generally opposite that of the first step portion; and a fourth step portion extending angularly upward from the third step portion.

24. The antenna of claim 23, wherein:

the first step portion meets the mounting surface at an angle of about two hundred twenty-five degrees;

the second step portion meets the first step portion at an angle of about one hundred five degrees;

the third step portion meets the mounting surface at an angle of about two hundred twenty-five degrees; and the fourth step portion meets the third step portion at an angle of about one hundred five degrees.

25. The antenna of claim 23, wherein the first and second step portions are mirror images of the third and fourth step portions, respectively.

26. The antenna of claim 19, wherein the reflective surfaces include:

a first slanted portion extending generally outwardly and downward from a first side of the mounting surface;

a second slanted portion extending generally outwardly and upwardly from the first slanted portion;

a third slanted portion extending generally outwardly and downwardly from a second side of the mounting surface generally opposite that of the first slanted portion; and a fourth slanted portion extending generally outwardly and upwardly from the third slanted portion.

27. The antenna of claim 26, wherein:

the first slanted portion meets the mounting surface so as to define an angled joint of about two hundred twenty-five degrees;

the second slanted portion meets the first slanted portion so as to define an angled joint of about one hundred five degrees;

the third slanted portion meets the mounting surface so as to define an angled joint of about two hundred twenty-five degrees; and the fourth slanted portion meets the third slanted portion so as to define an angled joint of about one hundred five degrees.

28. The antenna of claim 18, wherein the reflective surfaces include first, second, third, and fourth step portions, and wherein the antenna further comprises:

a first receiving void generally between the first and second step portions;

a second receiving void generally between the third and fourth step portions;

the first and second receiving voids configured for engagably receiving corresponding portions of a cover, to thereby provide a mechanical connection between the antenna housing and the cover.

29. The antenna of claim 28, wherein:

the first step portion extends angularly downward from a first side of the mounting surface;

the second step portion extends angularly downward from the first receiving void;

the third step portion extends angularly downward from a second side of the mounting surface generally opposite that of the first step portion; and the fourth step portion extends angularly downwardly from the second receiving void.

30. The antenna of claim 28, further comprising:

a first mounting feature generally below the second step portion;

a second mounting feature generally below the fourth step portion;

the first and second mounting features configured for mounting the antenna housing without significant interference to the electromagnetic radiation pattern provided by the antenna housing.

31. The antenna of claim 28, wherein the first step portion, first receiving void, and second step portions are mirror images of the third step portion, second receiving void, and fourth step portion, respectively.

32. The antenna of claim 28, wherein:

the first step portion meets the mounting surface at an angle of about one hundred ninety degrees;

the second step portion extends from the first receiving void at an angle of about one hundred ninety degrees;

the third step portion meets the mounting surface at an angle of about one hundred ninety degrees; and the fourth step portion extends from the second receiving void at an angle of about one hundred ninety degrees.

33. The antenna of claim 28, further comprising a cover having first and second portions engagable with the respective first and second receiving voids, to thereby mechanically retain the cover to the antenna housing, wherein said cover does not effect the pattern of radiation emitted by said radiation element.

34. The antenna of claim 19, wherein the reflective surfaces include:

a first step portion extending angularly from a first side of the mounting surface;

a second step portion extending angularly relative to the first step portion;

a third step portion extending angularly from a second side of the mounting surface generally opposite that of the first step portion; and a fourth step portion extending angularly relative to the third step portion.

35. The antenna of claim 18, wherein the at least one linear element is located directly above at least one of the reflective surfaces.

36. The antenna of claim 18, wherein the at least one linear element is spaced apart from the inner surface of the antenna housing.

37. The antenna of claim 18, where the at least one linear element is configured such that an electric field scattered off the at least one linear element helps shape the radiation pattern by adding to the radiation pattern and by redirecting energy to the reflective surfaces that are configured to reflect the electric field in a controlled manner that adds to the radiation pattern.

38. The antenna of claim 18, wherein the reflective surfaces and the at least one linear element are operable for controlling a pattern of radiation emitted by said at least one radiator.

39. The antenna of claim 18, wherein said first and second series of reflective surfaces each include at least two reflective surfaces such that the first series of reflective surfaces is a mirror-image of the second series of reflective surfaces first and second and such that the first and second series of reflective surfaces are symmetrical about the mounting surface.

* * * * *